US006655142B2

(12) United States Patent
Callas et al.

(10) Patent No.: US 6,655,142 B2
(45) Date of Patent: Dec. 2, 2003

(54) SEPARATE SHAFT TURBOCHARGER

(75) Inventors: James J. Callas, Peoria, IL (US); Frank G. Gerke, Chillicothe, IL (US); Delbert L. Kramer, Metamora, IL (US); Mark D. Moeckel, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/116,610

(22) Filed: Apr. 4, 2002

(65) Prior Publication Data

US 2003/0188534 A1 Oct. 9, 2003

(51) Int. Cl.[7] ..... F02G 3/00

(52) U.S. Cl. ..... 60/614; 60/624; 60/612

(58) Field of Search ..... 60/612, 614, 624, 60/598, 606; 123/561, 562, 564

(56) References Cited

U.S. PATENT DOCUMENTS

| | | | | |
|---|---|---|---|---|
| 2,570,101 A | * | 10/1951 | Couling | 60/624 |
| 2,585,968 A | * | 2/1952 | Schneider | 60/624 |
| 2,848,866 A | * | 8/1958 | Geislinger | 60/614 |
| 3,007,302 A | * | 11/1961 | Vincent | 60/614 |
| 3,090,194 A | * | 5/1963 | Glamann | 60/624 |
| 3,238,713 A | * | 3/1966 | Wallace | 60/624 |
| 4,344,289 A | | 8/1982 | Curiel et al. | 60/612 |
| 4,452,043 A | * | 6/1984 | Wallace | 60/624 |
| 4,586,337 A | * | 5/1986 | Fox | 60/624 |
| 4,638,634 A | | 1/1987 | McLean | |
| 4,760,704 A | | 8/1988 | Torigai | |
| 4,852,353 A | | 8/1989 | Holmer | |
| 5,020,327 A | | 6/1991 | Tashima et al. | |
| 5,063,744 A | | 11/1991 | Ishiyama et al. | |
| 5,081,842 A | | 1/1992 | Sugiyama et al. | |
| 5,109,674 A | | 5/1992 | Sudmanns | |
| 5,157,924 A | | 10/1992 | Sudmanns | 60/612 |
| 5,199,261 A | | 4/1993 | Baker | |
| 5,269,143 A | | 12/1993 | Cikanek et al. | |
| 5,408,979 A | | 4/1995 | Backlund et al. | |
| 5,488,827 A | | 2/1996 | Helmich et al. | |
| 5,697,217 A | | 12/1997 | Ramsden et al. | |
| 5,899,070 A | | 5/1999 | Droessler et al. | |

FOREIGN PATENT DOCUMENTS

| | | | | |
|---|---|---|---|---|
| JP | 62126226 A | * | 6/1987 | 60/624 |

* cited by examiner

*Primary Examiner*—Thomas Denion
*Assistant Examiner*—Thai-Ba Trieu
(74) *Attorney, Agent, or Firm*—Todd T Taylor

(57) ABSTRACT

A turbocharger for an internal combustion engine, is provided with a turbine including a rotatable turbine shaft, a turbine wheel carried by the turbine shaft, and a drive gear carried by the turbine shaft. A first compressor includes a rotatable first compressor shaft, a first compressor wheel carried by the first compressor shaft, and a first driven gear carried by the first compressor shaft. The first driven gear is operatively engaged with and driven by the drive gear. The turbocharger has a compact arrangement, and allows for optimization of compressor wheel operating speeds, including in a turbocharger having multiple compression stages.

21 Claims, 1 Drawing Sheet

SEPARATE SHAFT TURBOCHARGER

TECHNICAL FIELD

The present invention relates to turbochargers for use in internal combustion engines, and, more particularly, to a turbocharger having two or more compressor stages driven by one turbine.

BACKGROUND

A limiting factor in the performance of an internal combustion engine is the amount of combustion air that can be delivered to the intake manifold for combustion in the engine cylinders. Atmospheric pressure is often inadequate to supply the required amount of air for proper operation of an engine.

An internal combustion engine, therefore, may include one or more turbochargers for compressing air to be supplied to one or more combustion chambers within corresponding combustion cylinders. The turbocharger supplies combustion air at a higher pressure and higher density than existing atmospheric pressure and ambient density. The use of a turbocharger can compensate for lack of power due to altitude, or to increase the power that can be obtained from an engine of a given displacement, thereby reducing the cost, weight and size of an engine required for a given power output.

Each turbocharger typically includes a turbine driven by exhaust gases from the engine, and a compressor driven by the turbine. The compressor receives the air to be compressed and supplies the air to the combustion chamber. It is known to drive the compressor via a shaft carrying both the compressor wheel and the turbine wheel.

It is known to provide higher compression levels through the use of a multi-stage turbocharger. A known multi-stage turbocharger includes a turbine section and two or more compressor sections. A common shaft interconnects the turbine wheel of the turbine section with compressor wheels in the compressor sections. A stream of exhaust gases from the engine is conducted from the exhaust manifold to the turbine section of the turbocharger The stream of exhaust gases passing through the turbine section causes the turbine wheel to rotate, thereby turning the common shaft interconnecting the turbine wheel and the compressor wheels and rotating the compressor wheels.

Ambient air to be used for combustion in the internal combustion engine is brought into an inlet for the first compressor section. The air is compressed by the first compressor wheel, and passes from the first compressor section through a first compressor section outlet to the inlet of the second compressor section, for further compression. An interstage duct is used to conduct the compressed air from the first compressor section outlet to the inlet of the second compressor section. The out flow from the second compressor section exits the turbocharger at the second compressor section outlet, and is directed to the inlet manifold of the internal combustion engine.

U.S. Pat. No. 4,344,289 (Curiel et al.) discloses a supercharger with a two-stage compressor having two compressor wheels which are disposed in a back-to-back orientation relative to each other and carried by a common shaft. It is also known to provide two compressors operating to separately compress volumes of air supplied to a common duct. U.S. Pat. No. 5,157,924 (Sudmanns) discloses compressor wheels disposed in a face-to-face manner relative to each other, and which are carried by a common shaft.

Several problems are experienced with previously known constructions for turbochargers as described above. Providing a common shaft carrying the turbine wheel and two or more compressor wheels for separate compressor stages results in an undesirably large structure, difficult to arrange in an engine compartment. The combined mass of the turbine wheel and compressor wheels, even though positioned at different locations along the shaft, can cause shaft deflections. It is difficult to mount bearings accurately, and premature wear can be a problem. Further, since the compressor wheels are mounted directly on a single shaft, it has not been possible to optimize all compressor wheel speeds for optimum turbocharger performance.

The present invention is directed to overcoming one or more of the problems as set forth above.

SUMMARY OF THE INVENTION

In one aspect of the invention, a turbocharger for an internal combustion engine is provided with a turbine including a turbine shaft, a turbine wheel carried by the turbine shaft, and a drive gear carried by the turbine shaft. A compressor includes a compressor shaft, a compressor wheel carried by the compressor shaft, and a driven gear carried by the compressor shaft. The driven gear is operatively engaged with the drive gear.

In another aspect of the invention, an internal combustion engine is provided with a plurality of combustion cylinders, an intake manifold fluidly coupled for supplying combustion gas to the plurality of combustion cylinders, and an exhaust manifold fluidly coupled to receive a flow of exhaust gases from the plurality of combustion cylinders. A turbocharger includes a turbine having a rotatable turbine shaft, a turbine wheel carried by the turbine shaft, a drive gear carried by the turbine shaft and a turbine inlet and a turbine outlet associated with the turbine wheel. The turbine inlet is connected in flow communication with the exhaust manifold. A first compressor includes a first compressor shaft, a first compressor wheel carried by the first compressor shaft, a first driven gear carried by the first compressor shaft, and a first compressor inlet and a first compressor outlet associated with the first compressor wheel. The first driven gear is operatively engaged with the drive gear, and the first compressor outlet is connected in flow communication with the intake manifold.

In yet another aspect of the invention, a method of operating a turbocharger in an internal combustion engine is provided, with the steps of providing a turbine including a turbine shaft, a turbine wheel carried by the turbine shaft, and an inlet and an outlet associated with the turbine wheel; providing a first compressor including a first compressor shaft, a first compressor wheel carried by the first compressor shaft, and a first compressor inlet and a first compressor outlet associated with the first compressor wheel; providing driving engagement of the first compressor shaft with turbine shaft; circulating a fluid stream to the turbine inlet and through the turbine to the turbine outlet, and rotating the turbine wheel and the turbine shaft thereby; and rotating the first compressor shaft and the first compressor wheel through the driving engagement of the first compressor shaft and the turbine shaft.

DETAILED DESCRIPTION

Figure 1:
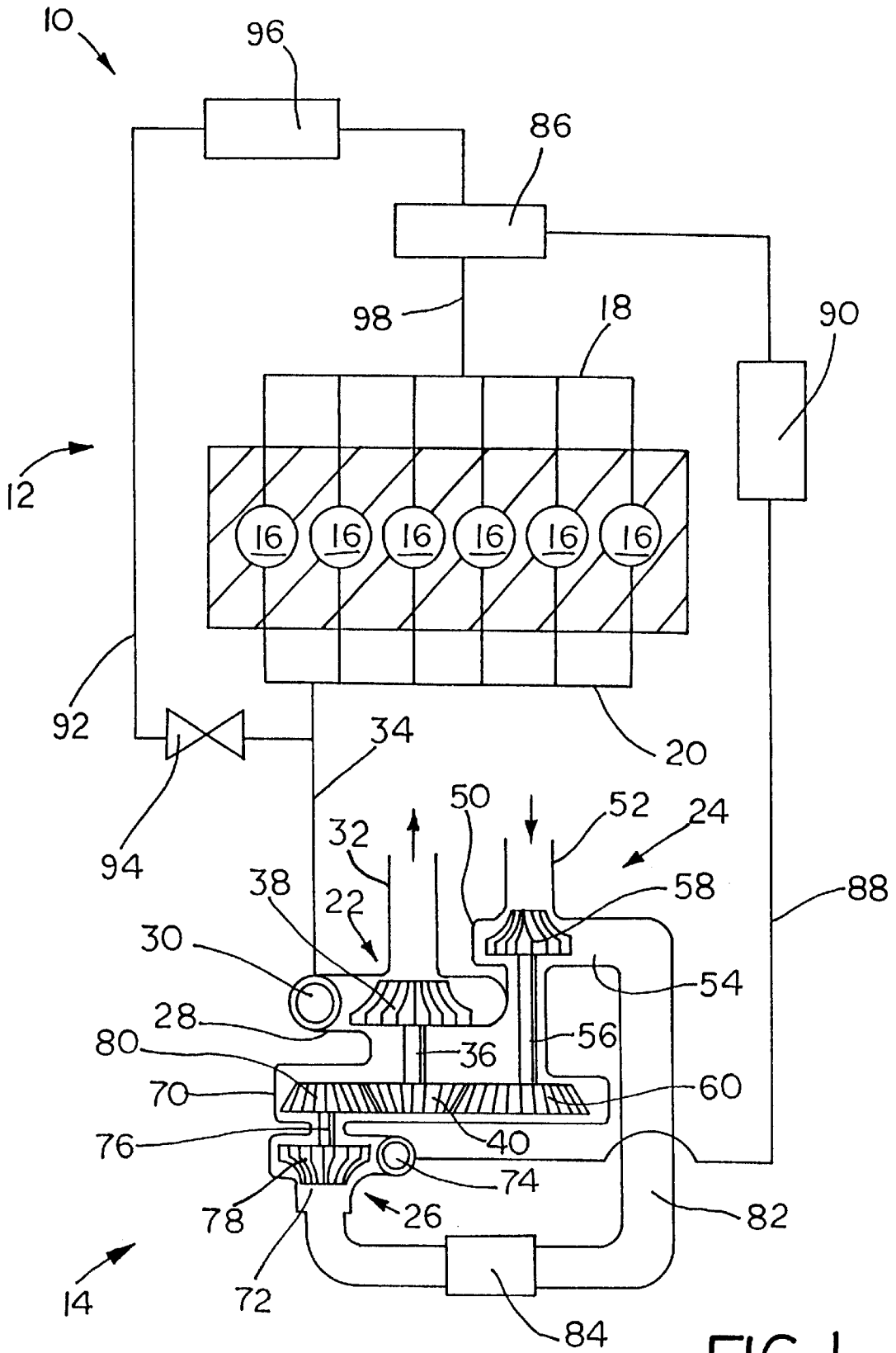
FIG. 1 is a schematic illustration of an internal combustion engine having a separate shaft turbocharger embodying the present invention.

Referring now to FIG. 1, an internal combustion engine 10 is shown having an exhaust gas recirculation (EGR)

system 12, and a turbocharger 14 in which the present invention for a separate shaft turbocharger may be used advantageously.

Internal combustion engine 10 includes a plurality of combustion cylinders 16, and as shown in FIG. 1, includes six combustion cylinders 16. Each combustion cylinder 16 is coupled with an intake manifold 18 and with an exhaust manifold 20. While a single intake manifold 18 is shown, it should be understood that more than one intake manifold may be used, with each intake manifold 18 coupled to a plurality of combustion cylinders 16, for providing an air mixture to each combustion cylinder 16. Further, while a single exhaust manifold 20 is shown, it should be understood that more than one exhaust manifold could be provided, with each exhaust manifold coupled to a different plurality of combustion cylinders 16. A fuel, such as diesel fuel, is introduced into each combustion cylinder and combusted therein, in a known manner.

Turbocharger 14 includes a turbine 22, a first compressor 24 and a second compressor 26. Turbine 22 includes a turbine casing 28 defining a turbine inlet 30 and a turbine outlet 32. Turbine inlet 30 is connected in flow communication with exhaust manifold 20 via a fluid conduit 34. Turbine outlet 32 is connected to a further exhaust system (not shown) of engine 10, which may include one or more mufflers, with subsequent discharge to an ambient environment.

Turbine 22 further includes a turbine shaft 36 rotatably disposed in turbine casing 28. A turbine wheel 38 is carried by turbine shaft 36, near one end turbine shaft 36. A drive gear 40 is also carried by turbine shaft 36, near the opposite end of turbine shaft 36 from turbine wheel 38. Turbine inlet 30 and turbine outlet 32 are each associated with turbine wheel 38, in known manner, such that a flow of fluid from exhaust manifold 20 enters turbine inlet 30 and flows past turbine wheel 38 to turbine outlet 32, causing rotation of turbine wheel.

First compressor 24 includes a first compressor casing 50 defining a first compressor inlet 52 and a first compressor outlet 54. First compressor inlet 52 receives combustion gas from a source such as ambient air, and first compressor outlet 54 supplies compressed combustion gas to engine 10, as will be described hereinafter.

First compressor 24 further includes a first compressor shaft 56 rotatably disposed in first compressor casing 50. A first compressor wheel 58 is carried by first compressor shaft 56, near one end of first compressor shaft 56. A first driven gear 60 is also carried by first compressor shaft 56, near the opposite end of first compressor shaft 56 from first compressor wheel 58. First driven gear 60 is drivingly coupled with drive gear 40 on turbine shaft 36, such that rotation of drive gear 40 by turbine shaft 36 causes rotation of first compressor shaft 56 and first compressor wheel 58. First compressor inlet 52 and first compressor outlet 54 are each associated with first compressor wheel 58, in known manner, such that fluid, such as ambient air, entering first compressor 24 through first compressor inlet 52 is compressed by first compressor wheel 58 in first compressor casing 50, while flowing to first compressor outlet 54.

Second compressor 26 includes a second compressor casing 70 defining a second compressor inlet 72 and a second compressor outlet 74. Second compressor 24 further includes a second compressor shaft 76 rotatably disposed in second compressor casing 70. A second compressor wheel 78 is carried by second compressor shaft 76, near one end of second compressor shaft 76. A second driven gear 80 is also carried by second compressor shaft 76, near an opposite end of second compressor shaft 76 from second compressor wheel 78. Second driven gear 80 is drivingly coupled with drive gear 40 on turbine shaft 36, such that rotation of drive gear 40 by turbine shaft 36 causes rotation of second compressor shaft 76 and second compressor wheel 78. Second compressor inlet 72 and second compressor outlet 74 are each associated with second compressor wheel 78, in known manner, such that fluid entering second compressor 24 through second compressor inlet 72 is compressed by second compressor wheel 78 in second compressor casing 70, while flowing to second compressor outlet 74.

Second compressor inlet 72 may receive combustion gas from a source such as ambient air, if first compressor 24 and second compressor 26 are operated in parallel, to each separately compress separate volumes of fluid. Alternatively, first compressor 24 and second compressor 26 can be operated in series, to sequentially compress fluid such as combustion gas. As illustrated in FIG. 1, an interstage duct 82 is provided, establishing flow communication between first compressor outlet 54 and second compressor inlet 72. For more efficient operation of second compressor 26, an optional interstage cooler 84 is provided in interstage duct 82, to cool the air compressed in first compressor 24 before second stage compression occurs in second compressor 26.

Second compressor outlet 74 is connected to a mixer 86 via a fluid conduit 88. An optional aftercooler 90 may be provided in conduit 88, to reduce the temperature of the compressed combustion air supplied from turbocharger 14.

EGR system 12 includes an EGR duct 92 receiving exhaust gas from exhaust manifold 20, to direct the exhaust gas to intake manifold 18. EGR duct 92 includes a valve 94 for controlling the flow of exhaust gas through duct 92. An EGR cooler 96 may be provided in duct 92, to lower the temperature of exhaust gas provided to intake manifold 18.

EGR duct 92 also is fluidly coupled to mixer 86. Mixer 86 controls the mixture of compressed combustion gas from turbocharger 14 with exhaust gas recirculated from EGR system 12, providing a mixture thereof to intake manifold 18 through a fluid conduit 98.

Industrial Applicability

During use of engine 10, a fuel, such as diesel fuel, is injected into combustion cylinders 16 and combusted when a piston (not shown) disposed within each combustion cylinder 16 is at or near a top dead center position. Exhaust gas is transported from each combustion cylinder 16 to exhaust manifold 20. Some of the exhaust gas within exhaust manifold 20 is transported to conduit 34 and inlet 30, for rotatably driving turbine wheel 38. The spent exhaust gas is discharged from turbine 22 to the ambient environment through turbine outlet 32.

Rotation of turbine wheel 38 by the flow of exhaust gases through turbine 22 rotates turbine shaft 36 and drive gear 40 carried by turbine shaft 36. Drive gear 40 is drivingly coupled with each first driven gear 60 and second driven gear 80, so that rotation of drive gear 40 rotates each first driven gear 60 and second driven gear 80. First driven gear 60 and second driven gear 80, being carried on first compressor shaft 56 and second compressor shaft 76, respectively, rotate the respective shaft by which they are carried. First compressor wheel 58 and second compressor wheel 78, similarly carried by first compressor shaft 56 and second compressor shaft 76, respectively, are rotatably driven together with first driven gear 60 and second driven gear 80, respectively. In this manner, turbine 22 drives each first compressor 24 and second compressor 26.

First compressor 24, driven by turbine 22 via turbine shaft 36 and first compressor shaft 56, draws combustion air into first compressor inlet 52. The combustion air is compressed within first compressor 24 and is discharged from compressor 24 through first compressor outlet 54. The compressed combustion air is conducted to second compressor inlet 72 via interstage duct 82, passing first through interstage cooler 84. Second compressor 26, driven by turbine 22 via turbine shaft 36 and second compressor shaft 76, further compresses the combustion air, discharging the now high pressure combustion air through second compressor outlet 74. The highly compressed combustion air flows through conduit 88 to mixer 86, first being cooled in aftercooler 90.

Exhaust gas is recirculated from exhaust manifold 20 to intake manifold 18 via EGR duct 92, mixer 86 and fluid conduit 98. Exhaust gas flow through EGR duct 92 is controlled by valve 94, with the exhaust gases being cooled by EGR cooler 96.

Mixer 86 combines fluid flow supplied by EGR system 12 through EGR duct 92 with compressed combustion air supplied by turbocharger 14 through fluid conduit 88. The mixture of the combined fluids is provided to intake manifold 18 through fluid conduit 98, for combustion in cylinders 16.

As shown in FIG. 1, first compressor shaft 56 and second compressor shaft 76 extend in opposite directions away from first driven gear 60 and second driven gear 80 carried, respectively, thereon. First compressor shaft 56 and turbine shaft 36 extend in the same direction away from first driven gear 60 and drive gear 40, respectively. Through the use of parallel, separate shafts for each turbine 22, first compressor 24 and second compressor 26, and with the proper selection of drive gear 40, first driven gear 60 and second driven gear 80, a variety of compact arrangements for turbocharger 14 are possible.

Each turbine shaft 36, first compressor shaft 56 and second compressor shaft 76 can be relatively short, and carries only a single wheel and gear thereon. Problems associated with a single shaft carrying several wheels thereon are reduced significantly. Further, with each first compressor wheel 58 and second compressor wheel 78 carried on and driven by separate shafts, the response of each to speed change is enhanced, and operating each at optimum speed is facilitated.

The separate shaft turbocharger of the present invention provides the capability of independent compressor wheel speeds. Through the selection of drive gear 40, first driven gear 60 and second driven gear 80, each of first compressor wheel 58 and second compressor wheel 78 can be caused to rotate within an optimal range of speeds for the design of the compressor wheel. It is no longer required that each first compressor wheel 58 and second compressor wheel 78 operate at the same speed, as is required when both are carried on a common shaft with the turbine wheel. Through the selection of gear ratios, each can be driven within an optimal range, and compressor wheel designs having efficiencies in different operating speed ranges now can be used in the same turbocharger.

While the present invention has been described for a turbocharger having two compressors, separate parallel shafts can be used also for a turbocharger having only one compressor associated with the turbine, or for a turbocharger having more than two compressors associated with the turbine. Further, while direct drives using gears drivingly engaged are preferred, it should be understood that other types of drive couplings, including belts and/or chains, also can be used. Those skilled in the art will readily understand the manner in which such alternative driving engagements can be used between turbine shaft 36 and first and second compressor shafts 56 and 76.

The turbocharger of the present invention provides a compact arrangement for a multistage turbocharger, with increased turbocharger performance through the optimization of speeds.

Other aspects, objects and advantages of this invention can be obtained from a study of the drawings, the disclosure and the appended claims.

What is claimed is:

1. A turbocharger for an internal combustion engine, comprising:

a turbine including a rotatable turbine shaft, a turbine wheel carried by said turbine shaft, and a drive gear carried by said turbine shaft; and a first compressor including a rotatable first compressor shaft, a first compressor wheel carried by said first compressor shaft, and a first driven gear carried by said first compressor shaft, said first driven gear operatively engaged with said drive gear for driving said compressor by said turbine.

2. The turbocharger of claim 1, including a second compressor having a rotatable second compressor shaft, a second compressor wheel carried by said second compressor shaft, and a second driven gear carried by said second compressor shaft, said second driven gear operatively engaged with said drive gear.

3. The turbocharger of claim 2, said turbine shaft, said first compressor shaft and said second compressor shaft disposed in a parallel relationship.

4. The turbocharger of claim 2, said first compressor shaft and said second compressor shaft extending in opposite directions from said gears carried thereby.

5. The turbocharger of claim 2, each said drive gear, said first driven gear and said second driven gear disposed at an end of said turbine shaft, said first compressor shaft and said second compressor shaft, respectively; and one of said first compressor shaft and said second compressor shaft extending from said gear carried thereby away from said turbine shaft.

6. The turbocharger of claim 2, including a first compressor inlet and first compressor outlet associated with said first compressor wheel, a second compressor inlet and second compressor outlet associated with said second compressor wheel, and an interstage duct establishing flow communication between said first compressor outlet and said second compressor inlet.

7. The turbocharger of claim 6, each said drive gear, said first driven gear and said second driven gear disposed at an end of said turbine shaft, said first compressor shaft and said second compressor shaft, respectively; and one of said first compressor shaft and said second compressor shaft extending from said gear carried thereby away from said turbine shaft.

8. The turbocharger of claim 6, said first compressor shaft and said second compressor shaft extending in opposite directions from said gears carried thereby.

9. The turbocharger of claim 6, said turbine shaft, said first compressor shaft and said second compressor shaft disposed in a parallel relationship.

10. A turbocharged internal combustion engine, comprising:

a plurality of combustion cylinders;

an intake manifold fluidly coupled for supplying combustion gas to said plurality of combustion cylinders;

an exhaust manifold fluidly coupled for receiving a flow of exhaust gases from said plurality of combustion cylinders; and a turbocharger, including:

a turbine having a rotatable turbine shaft, a turbine wheel carried by said turbine shaft, a drive gear carried by said turbine shaft, and a turbine inlet and a turbine outlet associated with said turbine wheel, said turbine inlet connected in flow communication with said exhaust manifold; and a first compressor having a rotatable first compressor shaft, a first compressor wheel carried by said first compressor shaft, a first driven gear carried by said first compressor shaft, and a first compressor inlet and first compressor outlet associated with said first compressor wheel, said first driven gear operatively engaged with said drive gear for driving said compressor by said turbine, and said first compressor outlet connected in flow communication with said intake manifold.

11. The turbocharged internal combustion engine of claim 10, including a second compressor having a rotatable second compressor shaft, a second compressor wheel carried by said second compressor shaft, a second driven gear carried by said second compressor shaft, and a second compressor inlet and a second compressor outlet associated with said second compressor wheel, said second driven gear operatively engaged with said drive gear.

12. The turbocharged internal combustion engine of claim 11, said turbine shaft, said first compressor shaft and said second compressor shaft disposed in a parallel relationship.

13. The turbocharged internal combustion engine of claim 11, said first compressor shaft and said second compressor shaft extending in opposite directions from said gears carried thereby.

14. The turbocharged internal combustion engine of claim 11, each said drive gear, said first driven gear and said second driven gear disposed at an end of said turbine shaft, said first compressor shaft and said second compressor shaft, respectively; and one of said first compressor shaft and said second compressor shaft extending from said gear carried thereby away from said turbine shaft.

15. The turbocharged internal combustion engine of claim 11, including an interstage duct establishing flow communication between said first compressor outlet and said second compressor inlet.

16. The turbocharged internal combustion engine of claim 15, said turbine shaft, said first compressor shaft and said second compressor shaft disposed in a parallel relationship.

17. The turbocharged internal combustion engine of claim 15, said first compressor shaft and said second compressor shaft extending in opposite directions from said gears carried thereby.

18. The turbocharged internal combustion engine of claim 15, each said drive gear, said first driven gear and said second driven gear disposed at an end of said turbine shaft, said first compressor shaft and said second compressor shaft, respectively; and one of said first compressor shaft and said second compressor shaft extending from said gear carried thereby away from said turbine shaft.

19. A method of operating a turbocharger in an internal combustion engine, comprising steps of:

providing a turbine including a turbine shaft, a turbine wheel carried by said turbine shaft, and an inlet and an outlet associated with said turbine wheel;

providing a first compressor including a first compressor shaft, a first compressor wheel carried by said first compressor shaft, a first compressor inlet and a first compressor outlet associated with said first compressor wheel;

providing driving engagement of said first compressor shaft with said turbine shaft;

circulating a fluid stream to said turbine inlet and through said turbine to said turbine outlet, and rotating said turbine wheel and said turbine shaft thereby;

rotating said first compressor shaft and said first compressor wheel through said driving engagement of said compressor shaft and said turbine shaft.

20. The method of claim 19, including the steps of:

providing a second compressor including a second compressor shaft, a second compressor wheel carried by said second compressor shaft, a second compressor inlet and a second compressor outlet associated with said second compressor wheel;

providing driving engagement of said second compressor shaft with said turbine shaft; and rotating said second compressor shaft and said second compressor wheel through said driving engagement of said second compressor shaft with said turbine shaft.

21. The method of claim 20, including providing an interstage duct and fluidly coupling said first compressor outlet with said second compressor inlet.

* * * * *